US011526102B2

(12) United States Patent
Toyonori

(10) Patent No.: US 11,526,102 B2
(45) Date of Patent: Dec. 13, 2022

(54) ELECTROPHOTOGRAPHIC BELT AND ELECTROPHOTOGRAPHIC IMAGE FORMING APPARATUS

(71) Applicant: CANON KABUSHIKI KAISHA, Tokyo (JP)

(72) Inventor: Masatsugu Toyonori, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/673,608

(22) Filed: Feb. 16, 2022

(65) Prior Publication Data

US 2022/0276589 A1 Sep. 1, 2022

(30) Foreign Application Priority Data

Feb. 22, 2021 (JP) ..... JP2021-026026
Jan. 13, 2022 (JP) ..... JP2022-003534

(51) Int. Cl.
*G03G 15/16* (2006.01)

(52) U.S. Cl.
CPC ..... *G03G 15/162* (2013.01)

(58) Field of Classification Search
CPC ..... G03G 15/162; G03G 21/0011
See application file for complete search history.

(56) References Cited

U.S. PATENT DOCUMENTS 10,088,789 B2 10/2018 Onishi et al. ..... G03G 15/5054
10,551,771 B2 2/2020 Uchida et al. ..... G03G 15/162
10,642,195 B2 5/2020 Ishio et al. ..... G03G 15/161
2011/0013952 A1* 1/2011 Shimazu ..... G03G 15/162 399/302
2019/0332038 A1* 10/2019 Saito ..... G03G 15/5054
2020/0073275 A1* 3/2020 Takazawa ..... G03G 15/043
2020/0174405 A1* 6/2020 Uchida ..... G03G 15/162
2020/0341408 A1* 10/2020 Matsuo ..... G03G 15/162
2020/0401073 A1* 12/2020 Saito ..... G03G 15/162
2021/0302908 A1* 9/2021 Ikari ..... G03G 5/056

FOREIGN PATENT DOCUMENTS

JP 2014-219505 11/2014
JP 2017-016076 1/2017
JP 2019-184960 10/2019
JP 2019-191568 10/2019

* cited by examiner

*Primary Examiner* — Carla J Therrien
(74) *Attorney, Agent, or Firm* — Venable LLP

(57) ABSTRACT

An electrophotographic belt having an endless shape, has grooves in an outer surface of the electrophotographic belt, and the grooves each are extending in a circumferential direction of the electrophotographic belt, wherein the outer surface has at least a first region in which the number of the grooves in a direction orthogonal to the circumferential direction of the electrophotographic belt is n, and a second region in which the number of the grooves in the direction orthogonal to the circumferential direction of the electrophotographic belt is more than n, and the grooves in the second region include a first groove that has a width gradually decreasing in a first circumferential direction of the electrophotographic belt, and a second groove that is adjacent to the first groove and has a width gradually decreasing in a second circumferential direction opposite to the first circumferential direction.

10 Claims, 14 Drawing Sheets

ELECTROPHOTOGRAPHIC BELT AND ELECTROPHOTOGRAPHIC IMAGE FORMING APPARATUS

BACKGROUND

The present disclosure relates to an electrophotographic belt such as a conveyance transfer belt or an intermediate transfer belt used in an electrophotographic image forming apparatus such as a copying machine or a printer, and an electrophotographic image forming apparatus.

DESCRIPTION OF THE RELATED ART

In an electrophotographic image forming apparatus, for example, an electrophotographic belt is used as an intermediate transfer belt that temporarily holds a toner image. A transfer residual toner on the electrophotographic belt is cleaned using a cleaning blade formed of an elastic member such as urethane rubber. Recently, in accordance with a demand for higher image quality for an electrophotographic image forming apparatus, an electrophotographic belt exhibiting stable cleaning characteristics has been required.

Japanese Patent Application Laid-Open No. 2019-191568 discloses a technique in which abrasion between a belt and a cleaning blade is suppressed by providing fine grooves formed in an outer surface of an electrophotographic belt and extending in a circumferential direction, and a transfer residual toner is stably removed for a long period of time. The belt has a first region in which the number of grooves formed in a direction orthogonal to the circumferential direction of the belt is n and a second region in which the number of grooves is more than n.

According to the studies by the present inventors, it has been confirmed that the electrophotographic belt according to Japanese Patent Application Laid-Open No. 2019-191568 can effectively suppress abrasion of a contact portion of the cleaning blade with the electrophotographic belt, and as a result, the transfer residual toner is reliably removed from the outer surface that is a bearing surface of the toner image even when used for a long period of time. However, in the course of the studies, as illustrated in FIG. 4, it has been found that a specular reflection light amount from the second region may be decreased greatly as the number of grooves formed in the direction orthogonal to the circumferential direction is increased.

Here, in an electrophotographic image forming apparatus capable of forming a color image, the following control may be performed in order to realize high color reproducibility. That is, there is a case where a toner image for correcting color registration (hereinafter, also simply referred to as a "correction toner image") is formed on the intermediate transfer belt, the correction toner image is detected by an optical sensor, and control for correcting the color registration is performed based on the detection result. The optical sensor detects the correction toner image by using a difference (contrast) between a reflection light amount from a portion where the correction toner image is not formed and a reflection light amount from a portion where the correction toner image is formed. Therefore, in the electrophotographic belt according to Japanese Patent Application Laid-Open No. 2019-191568, in a case where the specular reflection light amount from the second region is decreased, the contrast in the second region is decreased as compared with the contrast in the first region, and there is a possibility that the correction toner image in the second region cannot be accurately detected.

SUMMARY

At least one aspect of the present disclosure is directed to providing an electrophotographic belt that has two regions (a first region and a second region) in which the numbers of grooves are different in a circumferential direction and can sufficiently secure a specular reflection light amount from the second region in which the number of grooves is large. In addition, another aspect of the present disclosure is directed to providing an electrophotographic image forming apparatus that can stably form a high quality electrophotographic image.

According to an aspect of the present disclosure, there is provided an electrophotographic belt having an endless shape, having grooves in an outer surface of the electrophotographic belt, the grooves each extending in a circumferential direction of the electrophotographic belt, wherein the outer surface has at least a first region in which the number of the grooves in a direction orthogonal to the circumferential direction of the electrophotographic belt is n, where n represents an integer of 1 or more, and a second region in which the number of the grooves in the direction orthogonal to the circumferential direction of the electrophotographic belt is more than n, and the grooves in the second region include a first groove that has a width gradually decreasing in a first circumferential direction of the belt, and a second groove that is adjacent to the first groove and has a width gradually decreasing in a second circumferential direction opposite to the first circumferential direction.

According to another aspect of the present disclosure, there is provided an electrophotographic image forming apparatus including an intermediate transfer belt having an endless shape, and a cleaning member in contact with an outer circumferential surface of the intermediate transfer belt, in which the intermediate transfer belt is the electrophotographic belt.

Further features of the present disclosure will become apparent from the following description of exemplary embodiments with reference to the attached drawings.

DESCRIPTION OF THE EMBODIMENTS

Figure 5:
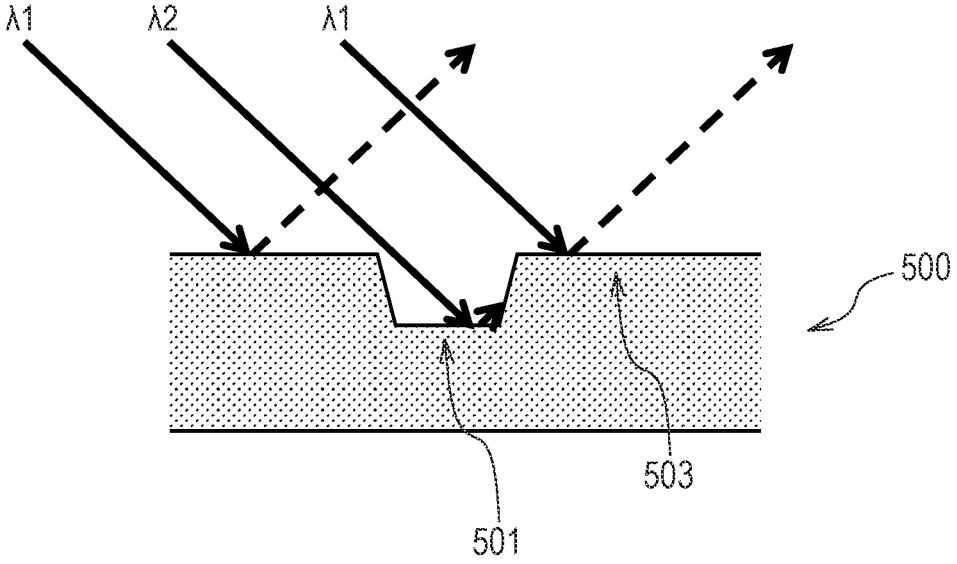
FIG. 5 is an explanatory view of a reflection state of light from a surface of a belt including grooves.

In an electrophotographic belt having an endless shape according to the present disclosure, grooves extending in a circumferential direction of the electrophotographic belt are provided in an outer surface. The outer surface has a first region in which the number of the grooves in a direction orthogonal to the circumferential direction of the electrophotographic belt is n, where n is an integer of 1 or more, and a second region in which the number of the grooves in the direction orthogonal to the circumferential direction of the electrophotographic belt is more than n. In such a configuration, the specular reflection light amount from the second region in which the number of grooves is relatively large is smaller than the specular reflection light amount from the first region. FIG. 5 is an enlarged cross-sectional view of an electrophotographic belt 500 having an outer surface in which grooves extend in a circumferential direction in a direction orthogonal to the circumferential direction. Among lights radiated on an outer circumferential surface of the electrophotographic belt 500, light (λ1) incident on a land portion 503 adjacent to a groove 501 is specularly reflected, and light (λ2) incident on a bottom portion of the groove 501 is reflected by, for example, a side surface of the groove 501, such that the specular reflection light amount is decreased. As the results, it is considered that the specular reflection light amount from the second region in which the number of grooves is relatively large is smaller than the specular reflection light amount from the first region.

Therefore, the present inventors have studied to reduce a difference between the specular reflection light amount in the second region and the specular reflection light amount in the first region.

As a result, the present inventors have found that it is effective to adjust widths of grooves adjacent to each other in the second region so that the grooves in the second region includes a first groove that has a width gradually decreasing in a first circumferential direction of the belt, and a second groove that is adjacent to the first groove and has a width gradually decreasing in a second circumferential direction opposite to the first circumferential direction.

That is, the specular reflection light amount from each region also depends on the width of each groove, and the specular reflection light amount is decreased as the width of the groove is relatively large. Therefore, the first groove formed in the second region has such a shape so that the width thereof gradually decreases in one direction of the circumferential directions (hereinafter, also referred to as a "circumferential direction A2") of the belt. In addition, at least one second groove of two grooves adjacent to the first groove has such a shape so that the width thereof gradually decreases in a direction opposite to the circumferential direction A2 (hereinafter, also referred to as a "circumferential direction A1"). More preferably, the degree of reduction of the first groove formed in the circumferential direction A2 and the degree of reduction of the second groove formed in the circumferential direction A 1 are complementary. Therefore, it is possible to suppress a decrease in specular reflection light amount in the second region due to a relatively large number of grooves as compared in the first region.

Hereinafter, an electrophotographic belt according to one aspect of the present disclosure will be described in detail. Note that the present disclosure is not limited to the following aspect.

Figure 1A:
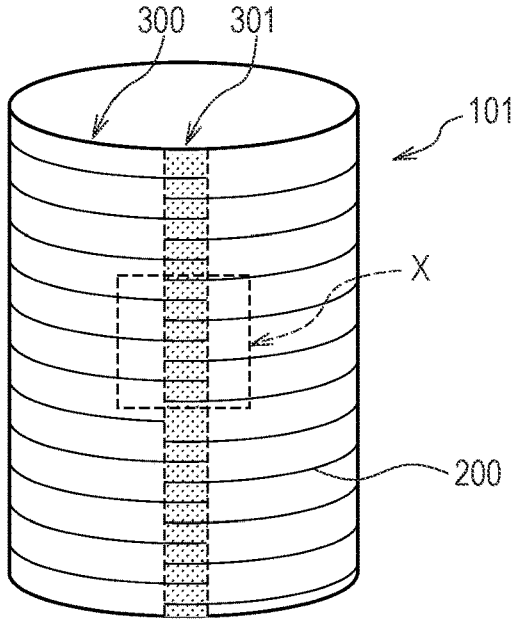
FIG. 1A is a schematic view illustrating a configuration of a surface of an electrophotographic belt based on the present disclosure.
Figure 1B:
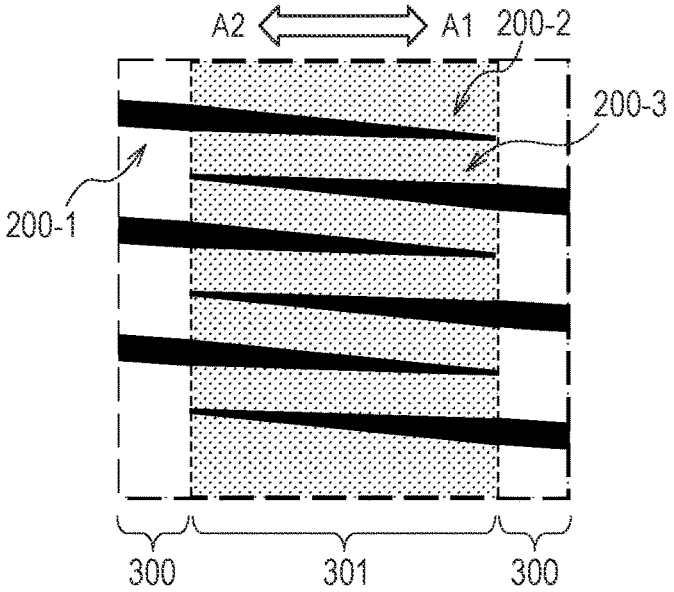
FIGS. 1B and 1C are partially enlarged views illustrating a state of grooves formed in a second region.

FIG. 1A is a schematic explanatory view of an outer circumferential surface of an electrophotographic belt (hereinafter, may be simply referred to as a "belt") 5 according to one aspect of the present disclosure, and FIG. 1B is a partially enlarged view of a region X in FIG. 1A.

Electrophotographic Belt

The belt 5 has an endless shape, and an outer surface of the belt 5 is provided with grooves 200 extending in a circumferential direction of the electrophotographic belt. The outer surface of the belt 5 has a first region 300 in which the number of the grooves in a direction orthogonal to the circumferential direction is n, and a second region 301 in which the number of the grooves in the direction orthogonal to the circumferential direction is more than n. Here, n is an integer of 1 or more, and the number thereof is not particularly limited as long as the outer surface can be stably cleaned by a cleaning member. As an example, in the first region, the number of the grooves per width of 1 mm in the direction orthogonal to the circumferential direction of the electrophotographic belt is preferably 8 to 500. Specifically, for example, when the total width in the direction orthogonal to the circumferential direction of the electrophotographic belt is 244 mm, the number n of the grooves in the first region is preferably n=1,952 to 122,000. In addition, when the total width is 360 mm, it is preferable that n=2,880 to 180,000. When the number of the grooves in the first region is within the range described above, an area of a portion of the cleaning member (not illustrated) in contact with a portion in which grooves 200 are not provided is reduced, such that a frictional force generated between the cleaning member and the electrophotographic belt 5 can be reduced. In addition, it is possible to suppress a decrease in specular reflection light amount from the second region due to an excessive increase in the number of grooves formed in the second region.

The first region 300 has the grooves 200-1. Widths of the grooves 200-1 are preferably constant. Here, "constant" means that an unavoidable dimensional variation in forming the grooves is "constant".

On the other hand, the second region 301 has a first groove 200-2 that has a width gradually decreasing in the first circumferential direction A 1 of the belt and a second groove 200-3 that is adjacent to the first groove 200-2 and has a width gradually decreasing in the second circumferential direction A 2 opposite to the circumferential direction A 1 . The first groove 200-2 and the second groove 200-3 are alternately arranged in the direction orthogonal to the circumferential direction of the belt. In the second region in which the number of the grooves is larger than that in the first region 300, the widths of the adjacent grooves are changed so as to be complementary to each other in one circumferential direction, for example, the first circumferential direction A 1 . By doing so, it is possible to more reliably suppress a decrease in specular reflection light amount in the second region due to an increase in the number of grooves.

The degree of gradual decrease in the width of each of the grooves 200-2 and 200-3 in the second region 301 is not particularly limited, and in order to stably maintain a preferred cleaning performance in the second region, it is preferable that the width decreases at a constant rate from one end to the other end in the circumferential direction of the belt in the second region.

The number of grooves formed in the second region is preferably 2n−10 or more and 2n+10 or less.

When the number of grooves formed in the second region is 2n−10 or more, a location of a contact portion of the cleaning member in a boundary between the first region and the second region can be stably changed. In addition, by setting the number of grooves formed in the second region to 2n+10 or less, a toner can be secondarily transferred more stably even in a case where the toner is primarily transferred onto the grooves.

Figure 2:
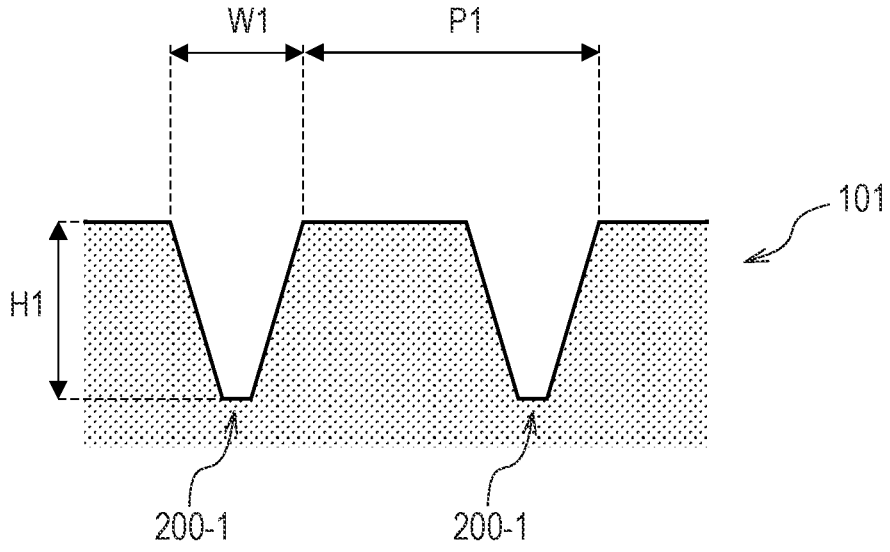
FIG. 2 is a schematic view illustrating a cross section of the electrophotographic belt based on the present disclosure in a direction orthogonal to a circumferential direction in a first region.

FIG. 2 illustrates a cross-sectional view of the belt 101 in the first region in the direction orthogonal to the circumferential direction. W1 represents a width of the groove, H1 represents a depth of the groove, and P1 represents an interval between the grooves.

Figure 3:
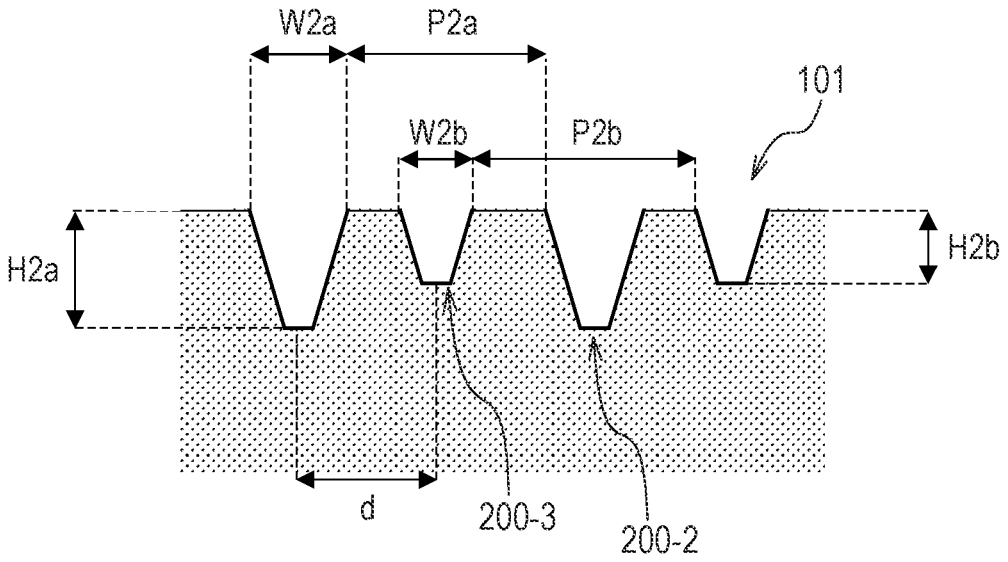
FIG. 3 is a schematic view illustrating a cross section of the electrophotographic belt based on the present disclosure in a direction orthogonal to a circumferential direction in the second region.
Figure 4:
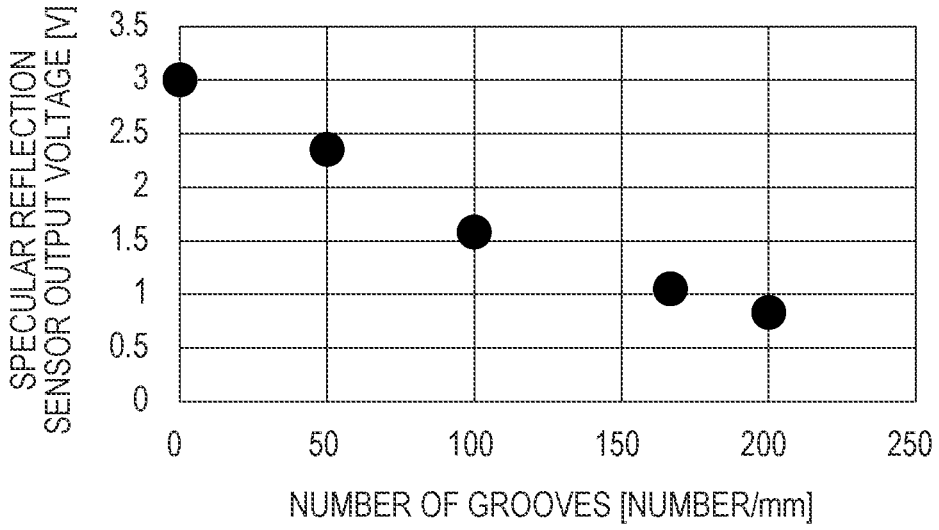
FIG. 4 is an explanatory view of a specular reflection sensor output with respect to the number of grooves per unit length in the direction orthogonal to the circumferential direction.

FIG. 3 illustrates a cross-sectional view of the belt 101 in the second region in the direction orthogonal to the circumferential direction.

In the second region, the first groove 200-2 that has a width gradually decreasing in the first circumferential direction A 1 of the belt 101 and a second groove 200-3 that is adjacent to the first groove 200-2 and has a width gradually decreasing in the second circumferential direction A2 opposite to the circumferential direction A1 are alternately arranged. Therefore, although it depends on an observation location, there are locations where narrow grooves and wide grooves are alternately provided. W2*a* and W2*b* represent the widths of the grooves, H2*a* and H2*b* represent the depths of the grooves, and P2*a* and P2*b* represent the intervals between the grooves. In addition, d represents an intercentral distance between adjacent grooves.

The intervals (P1, P2*a*, P2*b*, and d) between the adjacent grooves are not particularly limited as long as it is within a range of the number of grooves, and are preferably approximately uniform from the viewpoint of toner cleaning. For example, when the length of the belt in the direction orthogonal to the circumferential direction is 244 mm, P1 is preferably 2 μm to 122 μm. When P1 is 122 μm or less, 2,000 grooves can be formed in the first region, more preferred cleaning can be performed. In addition, when P1 is 2.0 μm or more, an excessive increase in the number of grooves formed in the second region can be suppressed.

A width (W1, W2*a*, or W2*b*) of the groove is preferably 0.10 μm to 3.00 μm, and more preferably 0.20 μm to 2.00 μm. When the width of the groove is 0.10 μm or more, the groove can be more reliably suppressed from disappearing due to abrasion of the outer surface caused by use of the electrophotographic belt. In addition, when the width of the groove is 3.00 μm or less, the deterioration of the secondary transferability of the toner when the toner is primarily transferred onto the groove can be effectively suppressed.

A depth (H1, H2*a*, or H2*b*) of the groove is preferably 0.10 μm or more and less than 5.00 μm, and more preferably 0.20 μm or more and less than 2.00 μm. When the depth of the groove is 0.10 μm or more, the groove can be more reliably suppressed from disappearing due to abrasion of the outer surface caused by use of the electrophotographic belt. In addition, when the depth of the groove is 5.00 μm or less, vignetting of reflection light from a bottom portion of the groove due to a wall of the groove can be reduced, which contributes to further suppression of a decrease in specular reflection light amount due to the groove. In addition, in the grooves 200-2 and 200-3 formed in the second region, it is preferable that the depth of the groove gradually decreases as the width of the groove gradually decreases. As the depth of the groove is shallower, vignetting of the reflection light from the bottom portion of the groove due to the wall of the groove can be reduced, and a decrease in specular reflection light amount can be suppressed. Therefore, when the depths of the grooves 200-2 and 200-3 are shallower, it is possible to more preferably suppress a decrease in specular reflection light amount due to an increase in the number of grooves formed in the second region.

Figure 1C:
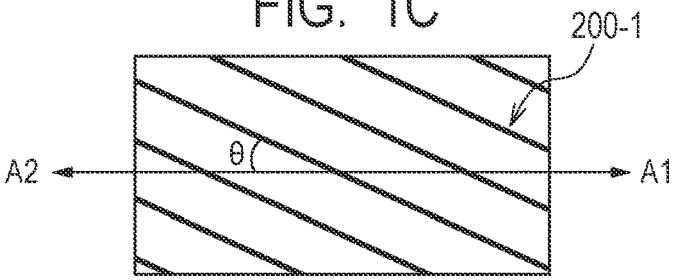

A direction in which the grooves 200 extend in the belt according to the present disclosure is preferably non-parallel to the circumferential direction of the belt. Specifically, a narrow angle θ (see FIG. 1C) formed by the groove 200-1 formed in the first region and the straight line A1-A2 parallel to the circumferential direction is preferably not 0° (θ≠0°), and greater than −3° and less than +3° . The fact that θ is 0° means the groove 200-1 extends parallelly to the circumferential direction. When θ is not 0°, a contact position of the cleaning member with the outer circumferential surface of the electrophotographic belt is not fixed, and wear of only a specific portion can be suppressed. In addition, when θ is greater than −3° and less than +3°, it is possible to suppress the abrasion between the cleaning member and the electrophotographic belt from becoming too large. In other words, the preferable numerical range of the narrow angle θ is, −3°<θ<0° and 0°<θ<+3°.

Figure 9A:
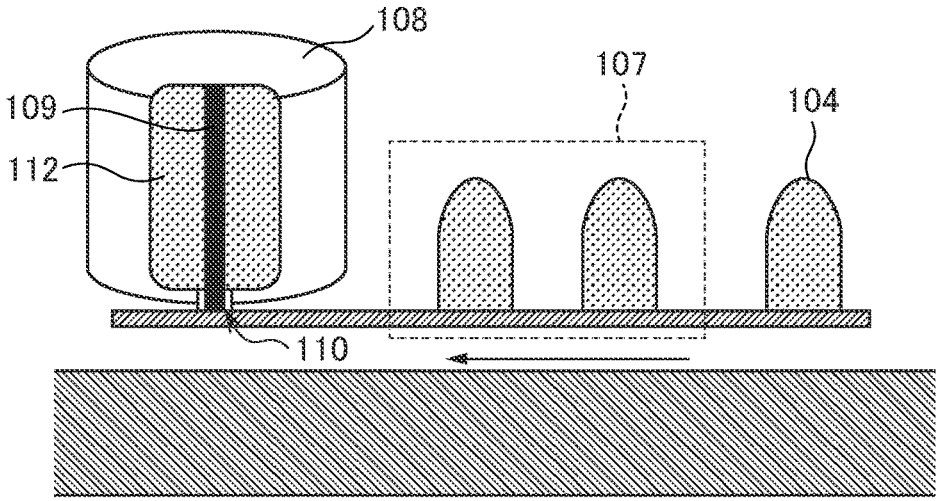
FIG. 9A is an explanatory view of stretch blow molding used for manufacturing the electrophotographic belt.
Figure 9B:
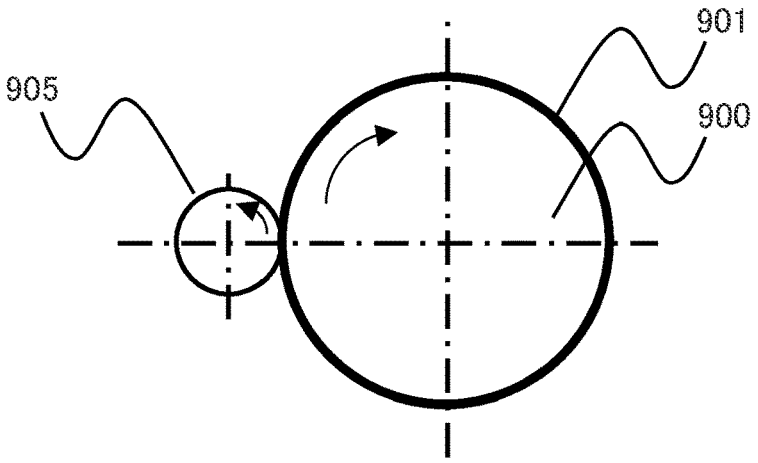
FIG. 9B is an explanatory view of an imprint processing apparatus used for forming grooves.
Figure 9C:
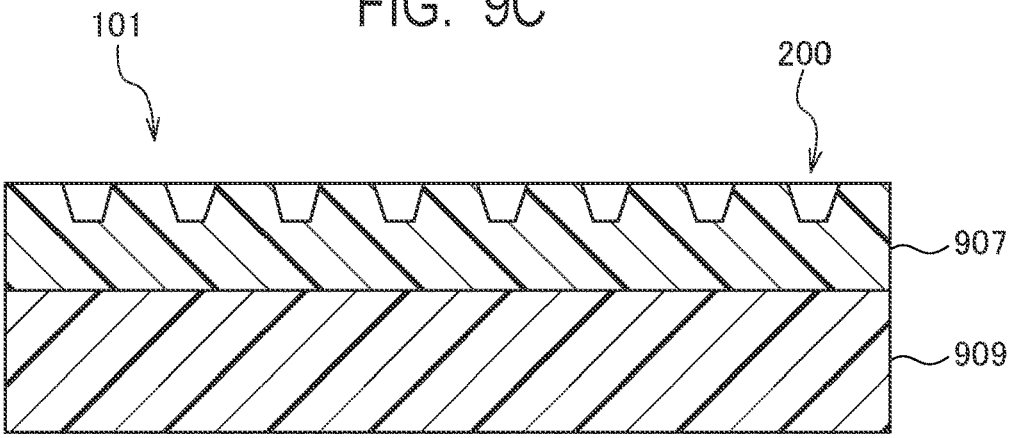
FIG. 9C is a cross-sectional view of an aspect of the electrophotographic belt in the direction orthogonal to the circumferential direction.

In an aspect of the electrophotographic belt, for example, as illustrated in FIG. 9C illustrating a cross section of the belt in the direction orthogonal to the circumferential direction in the first region, a base layer 909 having an endless shape and a surface layer 907 provided on an outer circumferential surface of the base layer can be provided, and the grooves 200-1 can be formed in a surface opposite to a surface of the surface layer facing the base layer.

In addition, an elastic layer (not illustrated) can be provided between the base layer 909 and the surface layer 907.

As a method of molding the base layer, a known molding method using a known thermoplastic resin or thermosetting resin can be used. Specific examples of a molding method using a thermoplastic resin include the following methods: methods of obtaining an electrophotographic belt having an endless belt shape by pelletizing a resin composition and molding the resin composition using a known molding method such as a continuous melt extrusion molding method, an injection molding method, a stretch blow molding method, or an inflation molding method.

The surface layer can be formed using, for example, a known method such as dip coating, spray coating, flow coating, shower coating, roll coating, spin coating, or ring coating.

Examples of a machining method for forming the groove can include known machining methods such as cutting machining, etching machining, and imprint machining. Imprint machining is preferable from the viewpoint of machining reproducibility or a machining cost of the groove.

A method of manufacturing the electrophotographic belt so that the groove 200 formed in the second region includes the groove 200-2 that has a width gradually decreasing in the first circumferential direction A1 and the groove 200-3 that has a width gradually decreasing in the second circumferential direction A2 as illustrated in FIG. 1B will be described with an example using an imprint machining method.

Note that the electrophotographic belt according to the present disclosure is not limited to those manufactured by this method.

The imprint machining method according to the present disclosure includes pressing a mold having a convex portion having a shape corresponding to a groove to be formed against a surface to be treated. Specifically, for example, as illustrated in FIG. 9B, a cured film of a film formed of a curable resin composition is formed on an outer circumferential surface of a substrate having an endless shape. Next, a substrate 901 having the cured film is held on an outer circumferential surface of a cylindrical holding mold 900.

Figure 10:
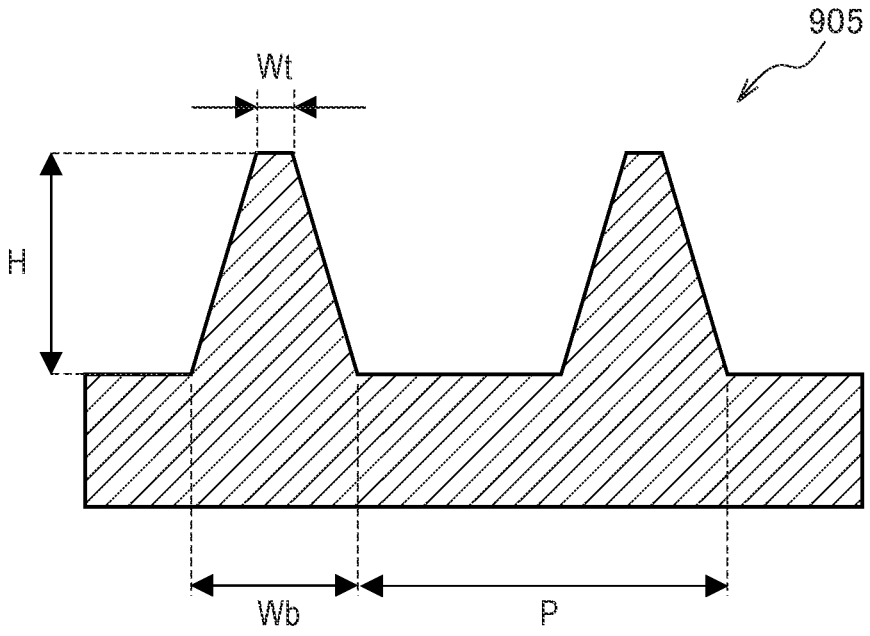
FIG. 10 is a schematic view illustrating an example of a cross-sectional shape of a convex of a cylindrical mold.

On the other hand, as the cylindrical mold, a cylindrical mold in which convex portions corresponding to widths, depths, and pitches of the grooves 200-1 to be formed in the first region are provided on the outer circumferential surface in a spiral shape over the entire circumference at an inclination of a predetermined angle so as to correspond to a narrow angle θ in a circumferential direction is prepared. Here, a shape of the convex portion is, for example, as illustrated in FIG. 10, a trapezoidal shape in a cross section in a direction orthogonal to a direction in which the convex portions extend at a predetermined angle in the circumferential direction of the cylindrical mold.

Next, a cylindrical mold 905 is arranged with respect to the cylindrical holding mold 900 holding the substrate 901 having the cured film so that rotation axes of the holding mold 900 and the cylindrical mold 905 are parallel to each other and a tip of the convex portion of the cylindrical mold 905 is in contact with an outer surface of the cured film.

While both the holding mold and the cylindrical mold 905 are rotated at a predetermined speed, the cylindrical mold 905 is pressed against the holding mold while gradually increasing the pressure at a predetermined rate. The pressure is maintained from the time when the pressure reaches a predetermined value, and a pressing force of the mold with respect to the holding mold is gradually reduced at a predetermined rate from the time when an initial contact position of the cured film with the mold on the holding mold is rotated one round to release the cylindrical mold 905. In this way, a convex shape of a surface of the cylindrical mold 905 is transferred onto the cured film.

Since the convex portions of the cylindrical mold 905 are formed in a spiral shape in the circumferential direction, a start point and an end point of the transferred groove do not coincide with each other. In addition, since the mold release is started from the time when the holding mold is rotated one round, the end point of the groove formed in a circumferential direction of the cured film is located downstream of the start point of the groove formed in a rotation direction. As a result, a first region in which the number of grooves formed in the direction orthogonal to the circumferential direction is n and a second region in which the number of grooves formed in the direction orthogonal to the circumferential direction is more than n are formed on the surface of the cured film.

A thickness of the electrophotographic belt is preferably 10 μm or more and 500 μm or less, and particularly preferably 30 μm or more and 150 μm or less. In addition, the electrophotographic belt of the present disclosure may be used not only as a belt but also as an electrophotographic member for winding or covering around a drum or a roll.

Electrophotographic Image Forming Apparatus

Figure 6:
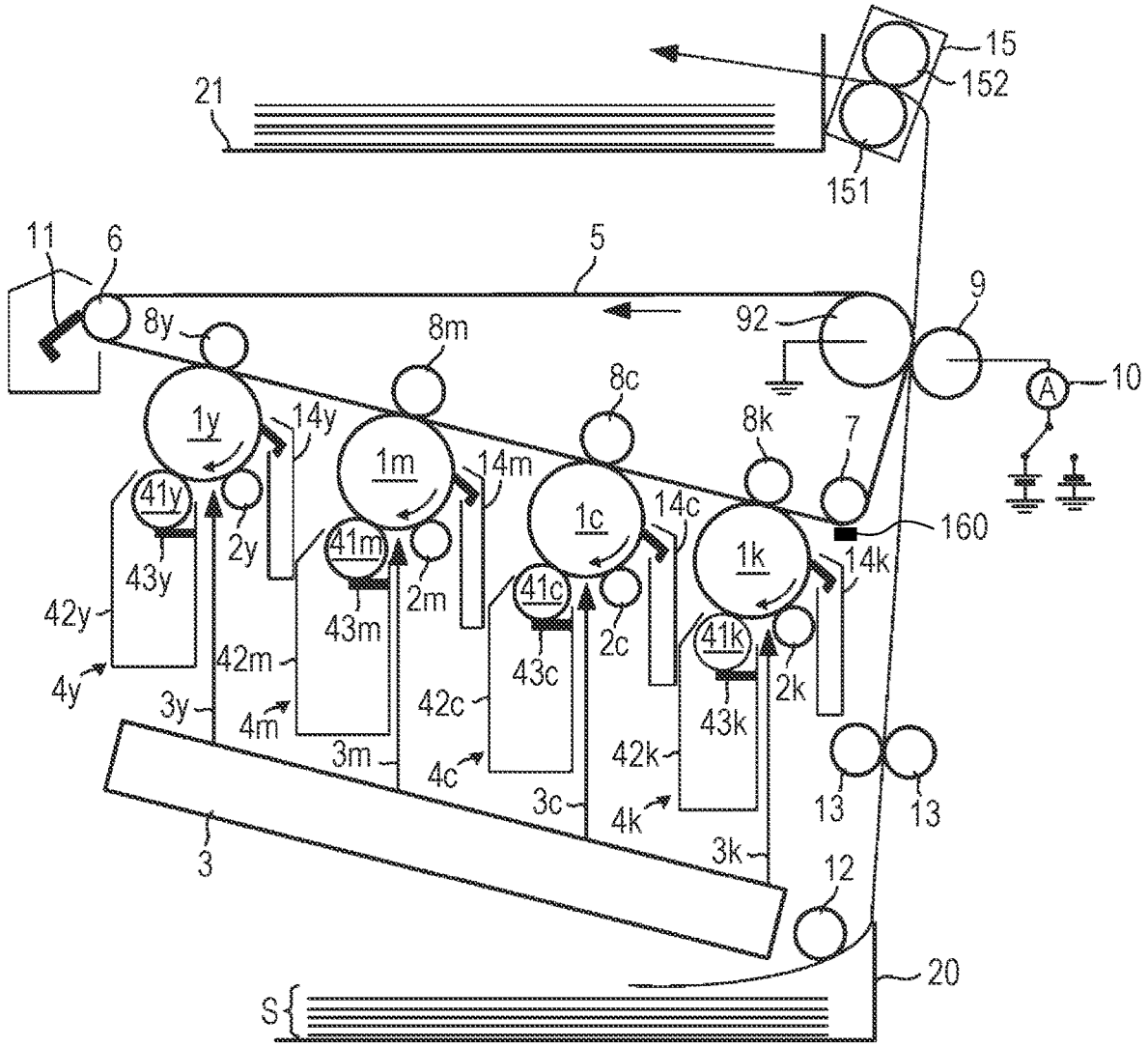
FIG. 6 is a schematic view illustrating an example of a configuration of an intermediate transfer-type electrophotographic image forming apparatus.

FIG. 6 illustrates a configuration example of an image forming apparatus in which the electrophotographic belt according to the present disclosure is mounted as an intermediate transfer body as an electrophotographic apparatus. The image forming apparatus performs color image formation using toners of four colors represented by C, M, Y, and K on a recording medium S such as a paper supplied from a paper feeding cassette 20, and is installed with an image forming station for each color in a substantially horizontal direction. The image forming station is provided with each of photosensitive drums 1*c*, 1*m*, 1*y*, and 1*k*. Here, a member to which the reference numeral is attached indicates which color of the image forming station of "cyan", "magenta", "yellow", or "black" belongs to, by adding "c", "m", "y", or "k" as a subscript to the reference numeral. The image forming apparatus is provided with a laser scanner 3 as a laser optical unit, and laser beams 3*c*, 3*m*, 3*y*, and 3*k* according to image signals of the respective colors are emitted toward the photosensitive drums 1*c*, 1*m*, 1*y*, and 1*k*, respectively.

Since all the image forming stations have the same structure, the image forming station for a K color (black) will be described here. An electro-conductive roller 2*k* as a contact charging device, a developing device 4*k*, an electro-conductive roller 8*k* as a primary transfer roller, a toner collection blade 14*k* used for cleaning the photosensitive drum 1*k* are arranged so as to surround the photosensitive drum 1*k*. The developing device 4*k* is provided with a developing roller 41*k* as a developer carrying member that develops a latent image on the photosensitive drum 1*k*, a developing container 42*k* that holds a toner to be supplied to the developing roller 41*k*, and a developing blade 43*k* that regulates the amount of toner on the developing roller 41*k* and applies a charge.

The electrophotographic belt 5 is implemented by an endless belt and is commonly provided in the image forming station of each of the colors. The electrophotographic belt 5 is stretched over a secondary transfer counter roller 92, a tension roller 6, and a drive roller 7, and is rotated by the drive roller 7 in a direction indicated by the arrow illustrated in the drawing. The electrophotographic belt 5 is sequentially in contact with surfaces of the photosensitive drums 1*y*, 1*m*, 1*c*, and 1*k* in a section between the tension roller 6 and the drive roller 7, and is pressurized toward each of the photosensitive drums 1*y*, 1*m*, 1*c*, and 1*k* by primary transfer rollers 8*y*, 8*m*, 8*c*, and 8*k*. Therefore, a toner image formed on the surface of each of the photosensitive drums 1*y*, 1*m*, 1*c*, and 1*k* is transferred onto the surface of the electrophotographic belt 5 that is an intermediate transfer body.

A secondary transfer roller 9 is provided to face the counter roller 92, and the electrophotographic belt 5 is pressurized toward the counter roller 92 by the secondary transfer roller 9. A secondary transfer voltage is applied to the secondary transfer roller 9 from a power supply via a current detection circuit 10. A secondary transfer unit includes the secondary transfer roller 9 and the counter roller 92. The recording medium S passes through a nip portion formed between the electrophotographic belt 5 and the secondary transfer roller 9 at the position of the counter roller 92 via a feeding roller 12 and a conveying roller 13, such that the toner image held on the outer circumferential surface of the electrophotographic belt 5 is transferred. Therefore, an image is formed on a surface of the recording medium S. The recording medium S onto which the toner image is transferred passes through a fixing device 15 including a pair of a heating roller 151 and a pressurizing roller 152, such that the image is fixed and discharged to a paper discharge tray 21.

A cleaning blade 11 in contact with the outer circumferential surface of the electrophotographic belt 5 is provided at the position of the tension roller 6. The toner that is not transferred onto the recording medium S and remains on the outer circumferential surface of the electrophotographic belt 5 is scraped off and removed by the cleaning blade 11. The cleaning blade 11 is a member extending in a direction substantially orthogonal to a movement direction of the electrophotographic belt 5.

The cleaning blade 11 is not particularly limited as long as it is suitable for toner cleaning. Examples thereof include urethane rubber, acrylic rubber, nitrile rubber, and EPDM rubber, and urethane rubber is preferable from the viewpoint of toner cleaning.

In the electrophotographic image forming apparatus, the color of a printed matter changes depending on conditions such as a use environment. Therefore, it is required to appropriately measure a density and feed back the measurement results to a control mechanism in a main body. The toner image for correcting a density is transferred onto the surface of the electrophotographic belt 5 and then conveyed to the position of the drive roller 7 along with the rotation of the electrophotographic belt 5. A toner density is detected by a density detection sensor 160 arranged on a side opposite to the drive roller 7 with the electrophotographic belt 5 as a boundary.

Figure 7:
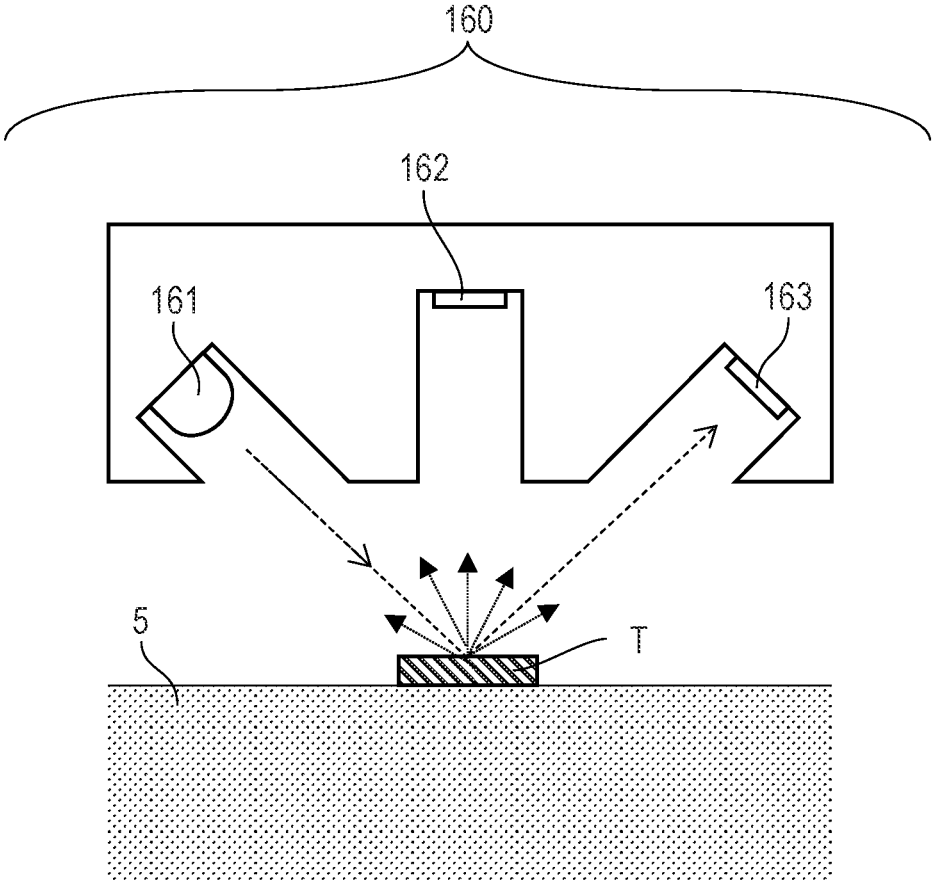
FIG. 7 is a schematic view illustrating an example of a configuration of a density detection sensor.

FIG. 7 is a schematic configuration view of the density detection sensor 160. The density detection sensor 160 includes a light emitting element 161, a diffuse reflection light receiving element 162, and a specular reflection light receiving element 163. The light emitting element 161 emits infrared light, and the light is reflected by a surface of a toner image T. The diffuse reflection light receiving element 162 is arranged at a position capable of receiving reflection light in a direction other than a specular reflection direction with respect to the position of the toner image T, and detects diffuse reflection light at the position of the toner image T. The specular reflection light receiving element 163 is arranged at a position capable of receiving reflection light in the specular reflection direction with respect to the toner image T, and detects specular reflection light at the position of the toner image T. The detected voltage values are referred to as a diffuse reflection output and a specular reflection output, respectively.

Figure 8A:
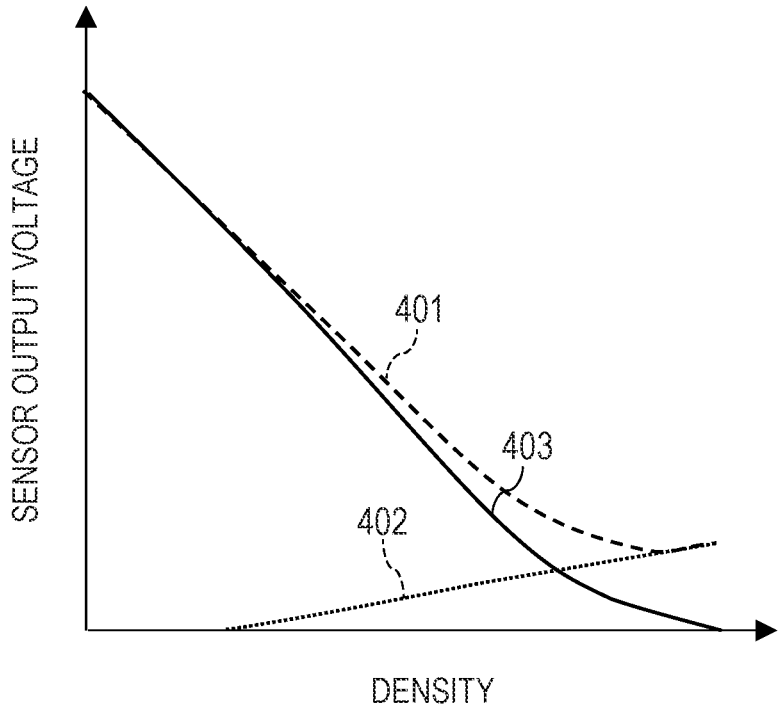
FIGS. 8A and 8B are schematic views illustrating an example of a density detection sensor difference output.

FIG. 8A is a schematic explanatory view illustrating a specular reflection output variation 401 with respect to the toner density, a diffuse reflection output variation 402, and a sensor output variation 403 calculated from these variation results. In a case where the amount of toner (toner density) is small, the specular reflection output is increased because a large amount of reflection from the surface of the electrophotographic belt 5, which is a smooth mirror surface, is detected. When the amount of toner (toner density) is increased, the specular reflection output is decreased. When the number of toner layers is one or more, a specular reflection component from the surface of the electrophotographic belt 5 is almost eliminated, but since the specular reflection output includes an output by a diffuse reflection component in addition to an output by the specular reflection component, the specular reflection output is not monotonically decreased in a region where the density is high. On the other hand, the diffuse reflection output is monotonously increased according to the amount of toner, but a change amount (increase amount) is smaller than a change amount (decrease amount) of the specular reflection output. By removing the output by the diffuse reflection component obtained based on the diffuse reflection output from the specular reflection output, the sensor output variation 403 (hereinafter, also referred to as a sensor output) having a correlation with the toner density is obtained.

Figure 8B:
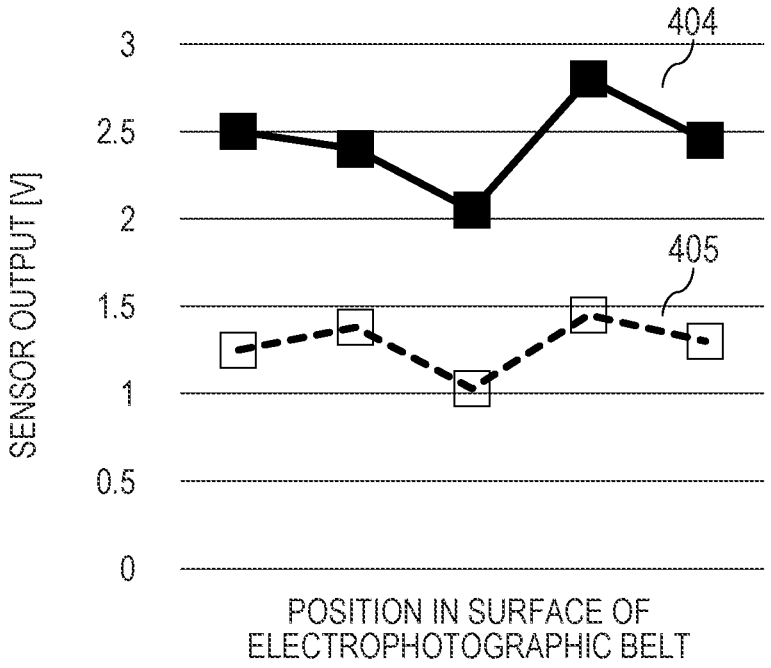

FIG. 8B is a schematic explanatory view illustrating a base output at locations on the surface of the electrophotographic belt 5 and a patch output at these locations. The base output refers to a sensor output in a state where the toner is absent, and the patch output refers to a sensor output in a state where the toner is present. As illustrated in FIG. 8B, a base output 404 varies at the position in the electrophotographic belt 5. Specifically, since a reflectance and a surface shape are locally different depending on the position in the surface of the electrophotographic belt 5, the specular reflection output changes, and as a result, the base output 404 that is a sensor output 403 varies. A patch output 405 detects a toner image formed at the same halftone density, but varies depending on the position in the surface of the electrophotographic belt 5, similar to the base output 404. That is, even when the toner density is the same, the patch output 405 varies depending on the variation in state of the base (the surface of the belt). Therefore, when the image density control is performed on the basis of the patch output 405 that does not accurately reflect the toner density itself, the accuracy of the image density control is degraded. In order to avoid such a degradation in accuracy as much as possible, it is preferable that the specular reflection output that is a main base output is as uniform as possible regardless of the position in the surface of the electrophotographic belt 5.

According to one aspect of the present disclosure, it is possible to obtain an electrophotographic belt that has two regions (a first region and a second region) in which the numbers of grooves formed in a direction orthogonal to the circumferential direction of the electrophotographic belt, are different, and can secure a specular reflection light amount from the second region. According to another aspect of the present disclosure, it is possible to obtain an electrophotographic image forming apparatus capable of stably forming a high quality electrophotographic image.

EXAMPLES

Hereinafter, the present disclosure will be specifically described with reference to Examples and Comparative Examples, but the present disclosure is not limited to the configurations embodied in Examples. Note that evaluation methods of a characteristic value and performance of an electrophotographic belt manufactured in each of Examples and Comparative Examples are as follows [Evaluation 1] to [Evaluation 5].

Evaluation 1

Evaluation of Number of Grooves Formed in Surface of Electrophotographic Belt and Length of Second Region in Circumferential Direction The state of the grooves formed in the surface of the electrophotographic belt was observed over the entire surface of the belt at a magnification of 10 times with a digital microscope (trade name: VHX-500, manufactured by Keyence Corporation), and the presence or absence of the first region and the second region and the number thereof, and the length of the second region were observed. Next, the number of grooves formed in the direction orthogonal to the circumferential direction in the first region and the second region was counted. As for the location where the number of grooves was counted, when the length of the region was 100 mm or less, one point at the center of the region was counted. As for the location where the length of the region was more than 100 mm, one point measurement was performed every 100 mm, and an arithmetic mean value thereof was calculated.

Evaluation 2

Evaluation of Shape of Groove Formed in Surface of Electrophotographic Belt

The surface of the electrophotographic belt was observed at a magnification of 50 times with a scanning white light interference microscope (trade name: Vert Scan, manufactured by Ryoka Systems Inc.) to confirm the width and depth of the groove. As for the location where the shape of the groove was measured, there were three points of a midpoint in a direction (width direction) orthogonal to the circumferential direction of the belt and a position of 100 mm on both end sides based on the midpoint in the first region and the second region. In addition, five points for each length of ⅕ of the length of each of the first region and the second region in the circumferential direction were evaluated.

Since the observation field of view when a 50× lens was used was 94.1 μm ×70.6 μm, which was narrow, images were acquired in fields of view using an image connection function, the shapes of 10 or more grooves per measurement point were measured from a cross-sectional shape profile, and an arithmetic mean value thereof was evaluated as a representative value. In the first region, all the grooves in the observation field of view were evaluated. In addition, in the second region, an odd-numbered groove and an even-numbered groove counted from the left end of the observation field of view were classified into a groove A and a groove B, and evaluation was performed.

Evaluation 3

Sensing Evaluation (Calculation of Change Rate of Specular Reflection Output)

Using the electrophotographic image forming apparatus illustrated in FIG. 6, the electrophotographic belt was mounted as an intermediate transfer body. Then, the specular reflection output per round of the electrophotographic belt was measured at an interval of 1 mm, and a deflection rate was evaluated using an arithmetic mean value Vave, a maximum value Vmax, a minimum value Vmin, and the following Equation (1). Note that the density detection sensor is arranged at a position of ±100 mm from the center in the width direction of the electrophotographic belt. In addition, since the specular reflection output varies depending on the condition of the groove provided in the surface of the electrophotographic belt, the light amount output was adjusted so that the specular reflection output in the first region was 3.0 V in this evaluation.

$$\text{Deflection rate}=(V_{max}-V_{min})/V_{ave} \quad \text{Equation (1)}$$

Evaluation 4

Evaluation of Toner Cleaning Performance

Using the electrophotographic image forming apparatus illustrated in FIG. 6, the electrophotographic belt was mounted as an intermediate transfer body, blade cleaning was performed while an image was printed, and the toner cleaning performance was evaluated.

In this evaluation, under an environment of a temperature of 15° C. and a relative humidity of 10%, Extra (basis weight of 80 g/m$^2$) manufactured by OCE N.V. and a paper with a JIS A4 size were used as the recording medium S, and the paper was passed with an upper limit of 200,000 sheets until a toner cleaning defect occurred during printing of two sheets. Then, the presence or absence of toner slipping-off from the cleaning blade was evaluated.

Specifically, first, the photosensitive drums 1*y* and 1*m* were irradiated with laser beams 3*y* and 3*m* so as to record red images (Y toner and M toner) on the entire surface with the A4 size in a state where the secondary transfer voltage was turned off (0 V). Thereafter, the secondary transfer voltage was set to an appropriate value, and three sheets were continuously fed in a blank state.

Since the secondary transfer voltage is not applied, the Y toner and the M toner transferred from the photosensitive drums 1*y* and 1*m* onto the entire surface of the electrophotographic belt 5 are hardly transferred onto the recording medium S in the secondary transfer portion and enter the cleaning blade 11. When these toners are removed from the electrophotographic belt, the three sheets to be passed after that are output in a completely blank state, but when these toners are not removed, the transferred toner slipped off from the cleaning blade 11 is transferred onto the recording medium S by the secondary transfer unit. That is, these toners are transferred onto a white paper and output onto the recording medium S as an image with a toner cleaning defect.

The evaluation described above was performed at the time of passing 50,000 sheets, at the time of passing 100,000 sheets, at the time of passing 150,000 sheets, and at the time of passing 200,000 sheets. Then, from the evaluation results, the electrophotographic belt was ranked according to the following criteria.

At the time when occurrence of a streak parallel to the conveyance direction of the recording medium S in the white ground portion of the recording medium S was visually observed, the occurrence of the toner cleaning defect was determined.

Rank A: No toner cleaning defect occurred in the process of passing 200,000 sheets.

Rank B: The toner cleaning defect occurred in the process of passing 200,000 sheets.

Rank C: The toner cleaning defect occurred in the process of passing 150,000 sheets.

Rank D: The toner cleaning defect occurred in the process of passing 100,000 sheets.

Rank E: The toner cleaning defect occurred in the process of passing 50,000 sheets.

Evaluation 5

Evaluation of Halftone Image Performance

Using the electrophotographic image forming apparatus illustrated in FIG. 6, the electrophotographic belt was mounted as an intermediate transfer body, and halftone red images (Y toner and M toner) were output. From the evaluation results, the electrophotographic belt was ranked according to the following criteria.

Rank A: No streaky density unevenness is observed.

Rank B: The streaky density unevenness is slightly observed.

Rank C: The streaky density unevenness is observed.

Example 1

Production of Base Layer

First, using a twin-screw extruder (trade name: TEX30α, manufactured by Japan Steel Works, Ltd.), the following base layer materials were thermally melt-kneaded at a ratio of PEN/PEEA/CB=84/15/1 (mass ratio) to prepare a thermoplastic resin composition. A thermal melt-kneading temperature was adjusted to be in a range of 260° C. or higher and 280° C. or lower, and a thermal melt-kneading time was set to about 3 to 5 minutes. The obtained thermoplastic resin composition was pelletized and dried at a temperature of 140° C. for 6 hours. Next, the dried pellet-like thermoplastic resin composition was injected into an injection molding apparatus (trade name: SE180D, manufactured by Sumitomo Heavy Industries, Ltd.). Then, a cylinder set temperature was set to 295° C., and injection molding was performed in a mold whose temperature was adjusted to 30° C., thereby preparing a preform. The obtained preform had a test tube shape having an outer diameter of 50 mm, an inner diameter of 46 mm, and a length of 100 mm.

Base Layer Material

PEN: Polyethylene naphthalate (trade name: TN-8050SC, manufactured by Teijin Chemicals Ltd.)

PEEA: Polyether ester amide (trade name: Pelestat NC6321, manufactured by Sanyo Chemical Industries, Ltd.)

CB: Carbon black (trade name: MA-100, manufactured by Mitsubishi Chemical Corporation)

Next, the preform is biaxially stretched using a biaxial stretching apparatus (stretch blow molding machine) illustrated in FIG. 9A. Before the biaxial stretching, a preform 104 was placed in a heating device 107 provided with a non-contact heater (not illustrated) for heating an outer wall and an inner wall of the preform 104, and the preform was heated with the heater so that an outer surface temperature of the preform was 150° C.

Next, the heated preform 104 was placed in a blow mold 108 whose mold temperature was maintained at 30° C., and the preform 104 was stretched in an axial direction using a stretching rod 109. At the same time, air whose temperature was adjusted to 23° C. was introduced into the preform from a blow air injection portion 110, and the preform 104 was stretched in a radial direction. Thus, a bottle-shaped molded article 112 was obtained.

Next, a body portion of the obtained bottle-shaped molded article 112 was cut to obtain a base layer for a seamless electrophotographic belt. The base layer for the electrophotographic belt had a thickness of 70.2 μm, a circumferential length of 712.2 mm, and a width of 244.0 mm.

Preparation of Coating Liquid

The following surface layer materials were weighed at a ratio of AN/PTFE/GF/SL/IRG=66/20/1.0/12/1.0 (a mass ratio in terms of solid content), and a solution obtained by subjecting the materials excluding SL to a coarse dispersion treatment was subjected to a main dispersion treatment using a high pressure emulsification disperser (trade name: Nano-Vater, manufactured by YOSHIDA KIKAI CO., LTD.) until a 50% average particle size of PTFE reached 200 nm. Furthermore, while SL was being stirred, the liquid after completion of the main dispersion treatment of PTFE was added dropwise to obtain a coating liquid for forming a surface layer. Note that a PTFE particle size in the coating liquid was measured using a concentrated particle size analyzer (trade name: FPAR-1000, manufactured by Otsuka Electronics Co., Ltd.) based on a dynamic light scattering (DLS) technique (ISO-DIS22412).

TABLE 1

| Abbreviation | Material name (trade name, manufacturer and the like) |
|---|---|
| AN: | Dipentaerythritol pentaacrylate and dipentaerythritol hexaacrylate (trade name: Aronix M-402, manufactured by TOAGOSEI CO., LTD.) |
| PTFE: | Polytetrafluoroethylene particle (trade name: LUBRON L-2, manufactured by DAIKIN INDUSTRIES, LTD.) |
| GF: | PTFE particle dispersant (trade name: GF-300, manufactured by TOAGOSEI CO., LTD.) |
| SL: | Zinc antimonate particle slurry (trade name: CELNAX CX-Z400K, manufactured by Nissan Chemical Corporation, 40% by mass as zinc antimonate particle component) |
| IRG: | Photopolymerization initiator (trade name: Irgacure 907, manufactured by BASF SE) |

Formation of Surface Layer

The base layer obtained by blow molding was fitted into an outer circumference of a cylindrical mold (circumferential length: 712 mm), an end was sealed, and then, the base layer was immersed in a container filled with the coating liquid (curable composition) together with the mold. A relative velocity between the liquid level of the curable composition and the base layer was pulled up to form a coating film formed of the coating liquid on a surface of the base layer. A film thickness determined by adjusting a pulling rate (the relative velocity between the liquid level of the curable composition and the base layer) and the solvent ratio of the curable composition can be obtained. In the present example, the pulling rate was set to 10 to 50 mm/sec, and the film thickness of the surface layer was adjusted to 3 μm.

In the present example, a coating direction refers to a direction opposite to a direction in which the base layer is pulled up. That is, a location initially pulled up from the coating liquid is the most upstream. The base layer coated with the coating liquid was removed from the cylindrical mold, and the base layer was dried under an environment of a temperature of 23° C. and exhaust air for 1 minute. A drying temperature and a drying time were appropriately adjusted according to the solvent type, the solvent ratio, and the film thickness. Thereafter, the coating film was irradiated with ultraviolet rays using a UV irradiator (trade name: UE06/81-3, manufactured by EYE GRAPHICS Co., Ltd.) until an integrated light amount reached 600 mJ/cm$^2$ to cure the coating film. The thickness of the surface layer was measured by a destruction inspection in which an electrophotographic belt separately manufactured under the same conditions was cut, and a cross section thereof was observed with an electron microscope (trade name: XL30-SFEG, manufactured by FEI). As a result of the destruction inspection, a thickness of the surface layer was 3.0 μm.

Formation of Grooves

Grooves were formed in a base layer 60 in which a cured film of a coating film was held using an imprint processing apparatus illustrated in FIG. 9B.

The imprint processing apparatus includes a cylindrical mold 905 for providing grooves and a cylindrical belt holding mold 900, and the cylindrical mold 905 can pressurize the cylindrical belt holding mold 900 while keeping an axis parallel. At this time, the cylindrical mold 905 and the cylindrical belt holding mold 900 rotate synchronously without sliding.

The cylindrical mold 905 is a mold formed of carbon steel plated with electroless nickel, and has a diameter of 50 mm and a length of 250 mm. A convex portion corresponding to the shape of the groove was formed on the surface of the cylindrical mold 905, and the convex patterns were formed in a spiral shape at an angle of 0.1° with respect to a circumferential direction of the cylindrical mold 905. A cross-sectional shape in a direction orthogonal to a circumferential direction of the convex portion corresponding to the groove formed in the cylindrical mold 905 used in the present example was a trapezoidal shape as illustrated in FIG. 10, and dimensions thereof are H =3.5 μm, Wb=2.0 μm, Wt=0.2 μm, and P=20 μm. A cartridge heater is embedded in the cylindrical mold 905 and can be heated.

A base layer on which a coating film was formed was previously fitted into an outer circumference of the cylindrical belt holding mold 900 (circumferential length: 712 mm). The cylindrical belt holding mold was rotated together with the cylindrical mold 905 at a circumferential speed of 1 mm/sec (the rotation directions of both the molds were opposite directions), and the cylindrical mold 905 heated to 130° C. was brought into contact with the cylindrical belt holding mold while axial center lines thereof were maintained in parallel, and a pressurizing force was increased to 8.0 kN at a rate of 1.0 kN/s. While the pressurizing force of the cylindrical mold 905 was increased, the cylindrical belt holding mold 900 and the cylindrical mold 905 were continuously rotated. Thereafter, the cylindrical belt holding mold 900 and the cylindrical mold 905 were rotated while maintaining the pressurizing force at 8.0 kN.

Then, at the time when the position of the cylindrical belt holding mold 900 in contact with the cylindrical mold 905 for the first time was rotated one round, the pressurizing force of the cylindrical mold 905 was reduced at a rate of 1.0 kN/s to release the cylindrical mold 905. Therefore, the pattern of the convex portions of the cylindrical mold 905 was transferred onto the surface of the electrophotographic belt to form grooves. Since the convex patterns of the cylindrical mold 905 had a spiral shape, the start end and the final end of the groove were not connected when the cylindrical mold was rotated one round, and the second region having a larger number of grooves than in the first region was formed.

The groove pattern of the electrophotographic belt obtained in the above steps had one first region and one second region, the number of grooves formed in the first region was 12,200, the number of grooves formed in the second region was 24,401, and the length of the second region in the circumferential direction was 7.8 mm.

The width and depth of the groove formed in the first region were as follows.

W1=0.6 μm

H1=0.6 μm

P1=20 μm

In the present example, three fields of view were observed per measurement point, and 14 grooves were evaluated.

Figure 11A:
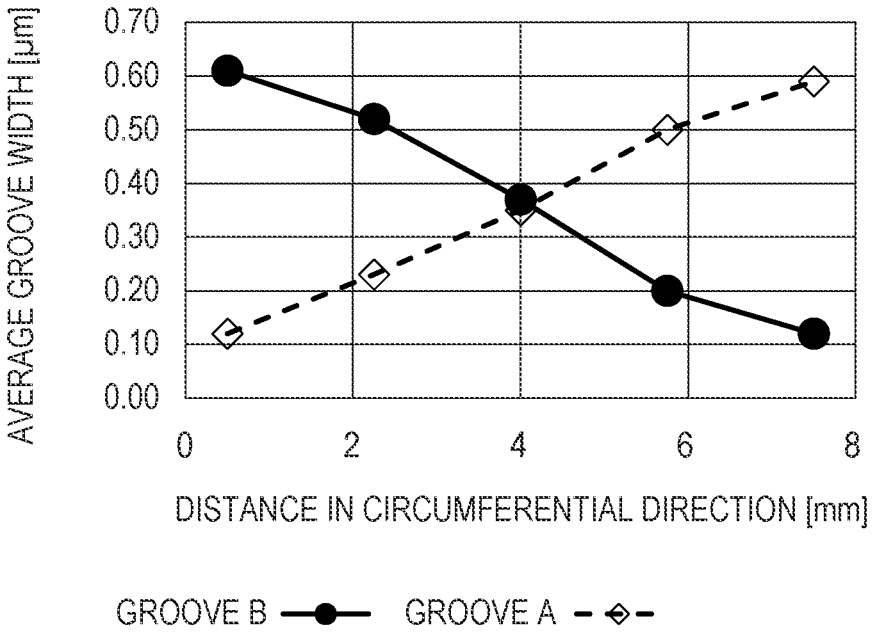
FIGS. 11A and 11B are explanatory views of a groove shape in a second region of Example 1.
Figure 11B:
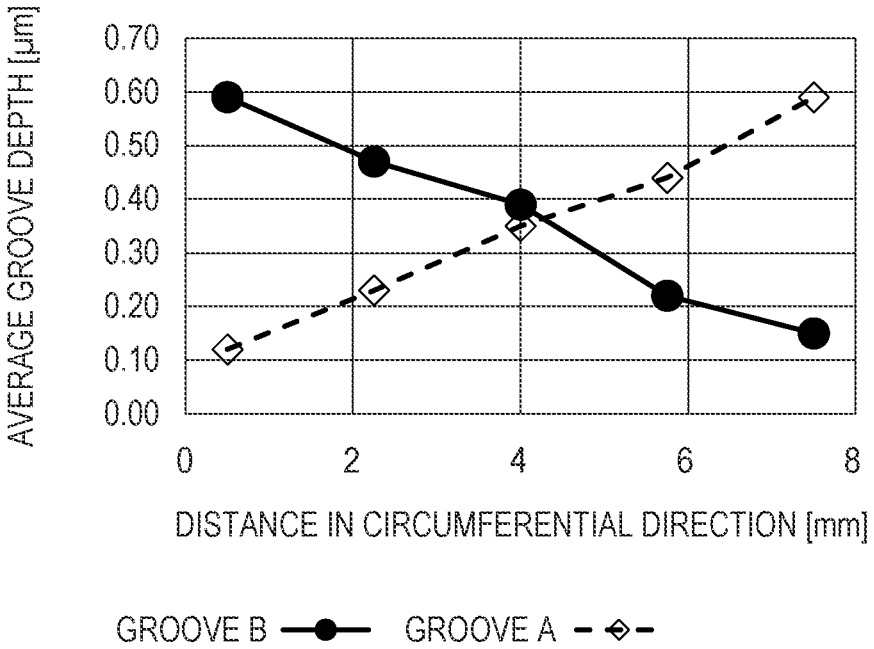

FIGS. 11A and 11B illustrate the average groove widths (W2*a* and W2*b*) and the average groove depths (H2*a* and H2*b*) of the groove A (corresponding to the groove 200-3 in FIG. 1B) and the groove B (corresponding to the groove 200-2 in FIG. 1B) formed in the circumferential direction of the belt in the second region. Note that in FIGS. 11A and 11B, the origin point (0 mm) of the distance in the circumferential direction on the horizontal axis is the position on the most A2 direction side of the second region illustrated in FIGS. 1A and 1B. In addition, the interval between the grooves was as follows.

P2*a*=20 μm

P2*b*=20 μm d=10 μm

As illustrated in FIG. 11A, the groove width of the groove B (corresponding to the groove 200-2 in FIG. 1B) gradually decreased in the circumferential direction A1 of the belt. In addition, as illustrated in FIG. 11B, the depth of the groove B gradually decreased in the circumferential direction A1 of the belt. The aforementioned changes in the width and the depth of the groove B are resulting from (i) the cross-sectional shape of the convex portion of the cylindrical mold 905 in the direction orthogonal to the circumferential direction was a substantially trapezoidal shape as illustrated in FIG. 10, and (ii) the groove B was formed by increasing the pressurizing force with the cylindrical mold 905 at a predetermined rate during the process in which the cylindrical mold 905 was rotationally moved in the direction A2 and the pattern of the convex portion of the cylindrical mold 905 was transferred onto the cured film.

On the other hand, as illustrated in FIG. 11A, the groove A (corresponding to the groove 200-3 in FIG. 1B) gradually decreased in the circumferential direction A2 of the belt. In addition, as illustrated in FIG. 11B, the depth of the groove A gradually decreased in the circumferential direction A2 of the belt. The changes of the width and the depth of the groove A are resulting from (i) the cross-sectional shape of the convex portion of the cylindrical mold 905 in the direction orthogonal to the circumferential direction is a substantially trapezoidal shape as illustrated in FIG. 10, and (ii) the groove A was formed by reducing the pressurizing force with the cylindrical mold 905 at a predetermined rate during the process in which the cylindrical mold 905 was rotationally moved in the direction A2 and the pattern of the convex portion of the cylindrical mold 905 was transferred onto the cured film to form the second region 301.

The electrophotographic belt was mounted on the electrophotographic image forming apparatus illustrated in FIG. 6, and specular reflection output was evaluated. As a result, waveforms illustrated in FIGS. 12A and 12B were obtained.

Figure 12A:
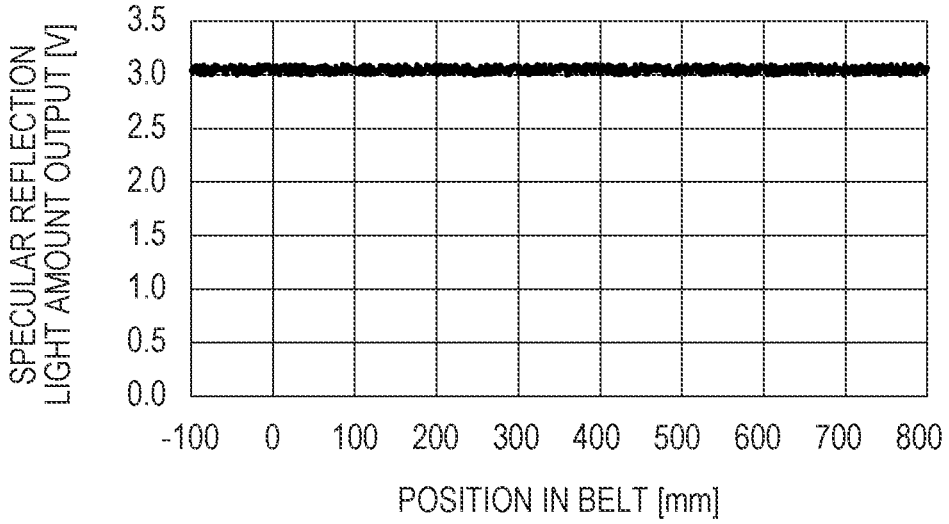
FIGS. 12A and 12B are explanatory views of results of sensing evaluation of a belt of Example 1.
Figure 12B:
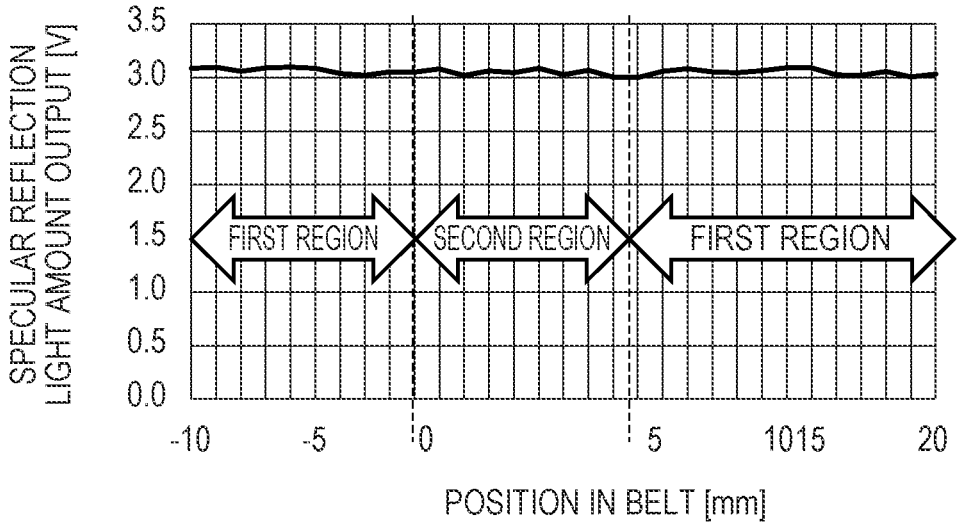

FIG. 12A is a chart showing specular reflection output in the entire circumferential direction of the electrophotographic belt. In addition, FIG. 12B is an enlarged chart obtained by extracting the vicinity of the second region from the chart illustrated in FIG. 12A. As is clear from FIGS. 12A and 12B, in the electrophotographic belt according to the present example, in the first region and the second region, the specular reflection light amount output was equivalent, and the deflection rate calculated using Equation (1) was 3%.

In addition, the cleaning performance was evaluated. It was determined that the electrophotographic belt was ranked as A when the toner cleaning defect did not occur in the process of passing 200,000 sheets.

The electrophotographic belt was mounted on the electrophotographic image forming apparatus illustrated in FIG. 6, and the halftone image performance was evaluated. It was determined that the electrophotographic belt was ranked as A when no streaky density unevenness due to the groove pattern formed in the surface of the electrophotographic belt was observed.

Comparative Example 1

When forming grooves using an imprint processing apparatus, the cylindrical mold 905 was pressurized to 8.0 kN with respect to the cylindrical belt holding mold 900 in a state where the cylindrical mold 905 and the cylindrical belt holding mold 900 were stopped, the cylindrical belt holding mold 900 and the cylindrical mold 905 were rotated while the pressurizing force was maintained at 8.0 kN, and the cylindrical belt holding mold 900 and the cylindrical mold 905 were stopped at the time when the portion where the cylindrical belt holding mold 900 was started to be in contact with the cylindrical mold 905 was rotated more than one round of the cylindrical belt holding mold 900. Then, the cylindrical mold 905 was depressurized to 0 kN with respect to the cylindrical belt holding mold 900 in a state where the cylindrical mold 905 and the cylindrical belt holding mold 900 were stopped.

An electrophotographic belt was manufactured in the same manner as that of Example 1 except for the above.

Figure 13A:
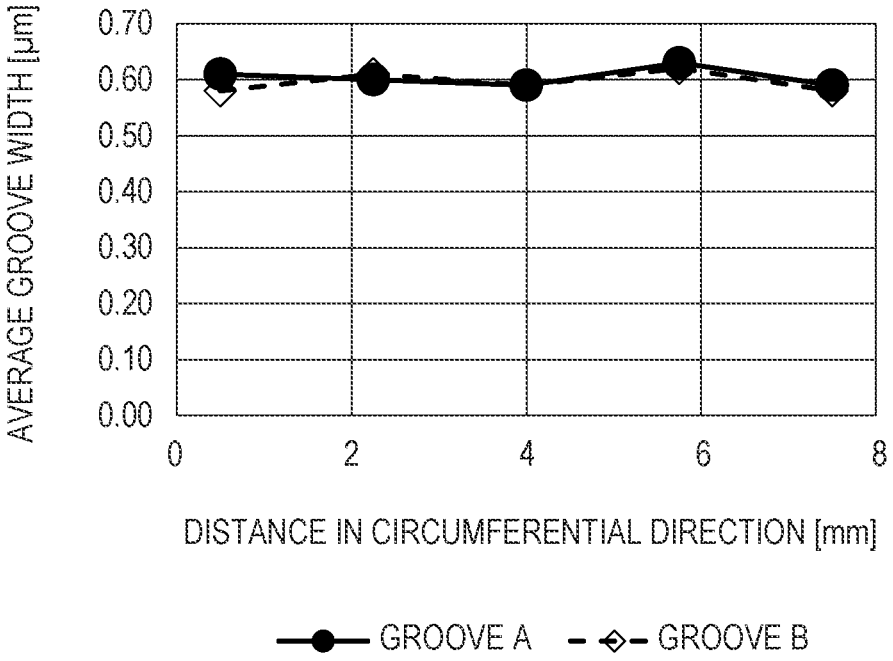
FIGS. 13A and 13B are explanatory views of a groove shape in a second region of Comparative Example 1.
Figure 13B:
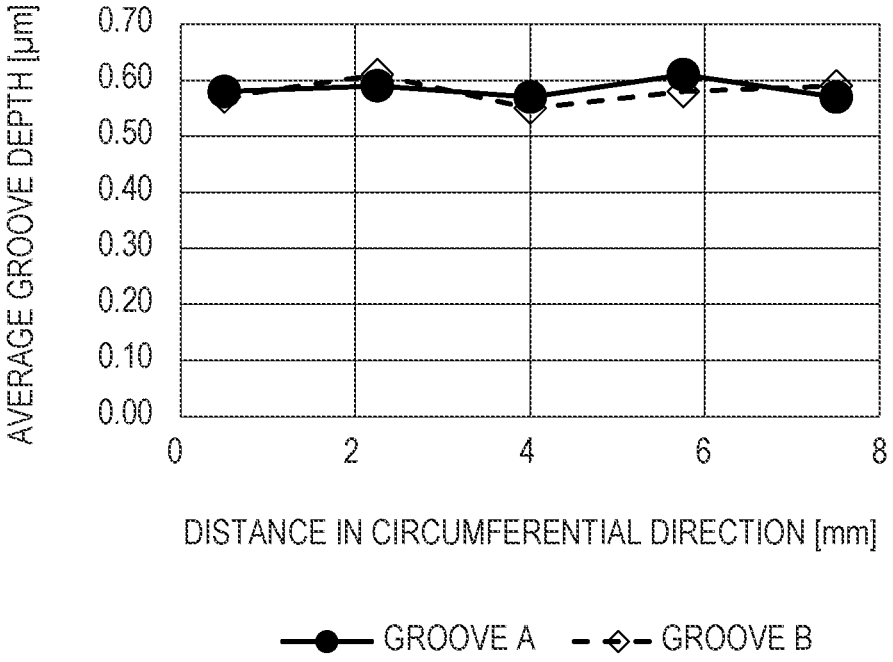

FIGS. 13A and 13B illustrate the average groove widths (W2*a* and W2*b*) and the average groove depths (H2*a* and H2*b*) of the groove A and the groove B formed in the circumferential direction of the belt in the second region in the manufactured electrophotographic belt.

As illustrated in FIGS. 13A and 13B, the groove widths and the groove depths in the circumferential direction of the grooves (corresponding to the grooves 200-2 and 200-3 according to the present disclosure) adjacent in the direction orthogonal to the circumferential direction in the second region were constant.

Figure 14A:
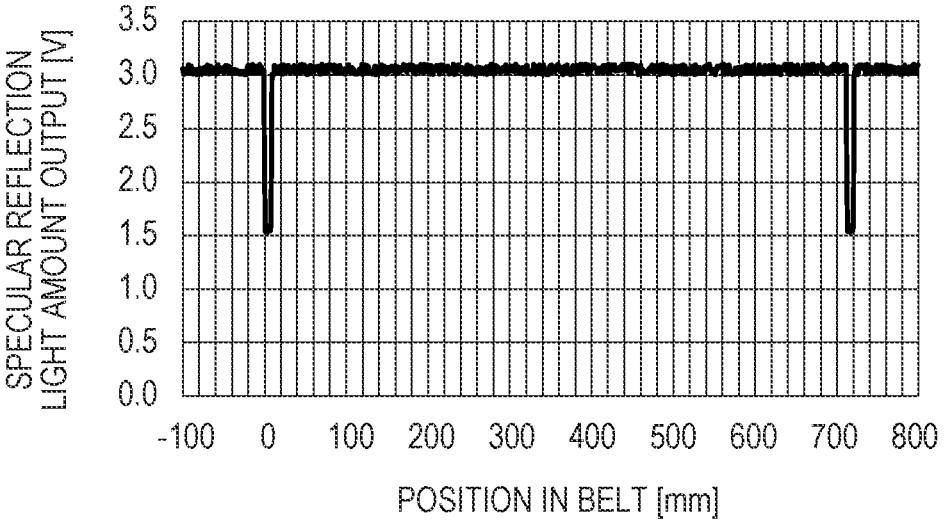
FIGS. 14A and 14B are explanatory views of results of sensing evaluation of a belt of Comparative Example 1.
Figure 14B:
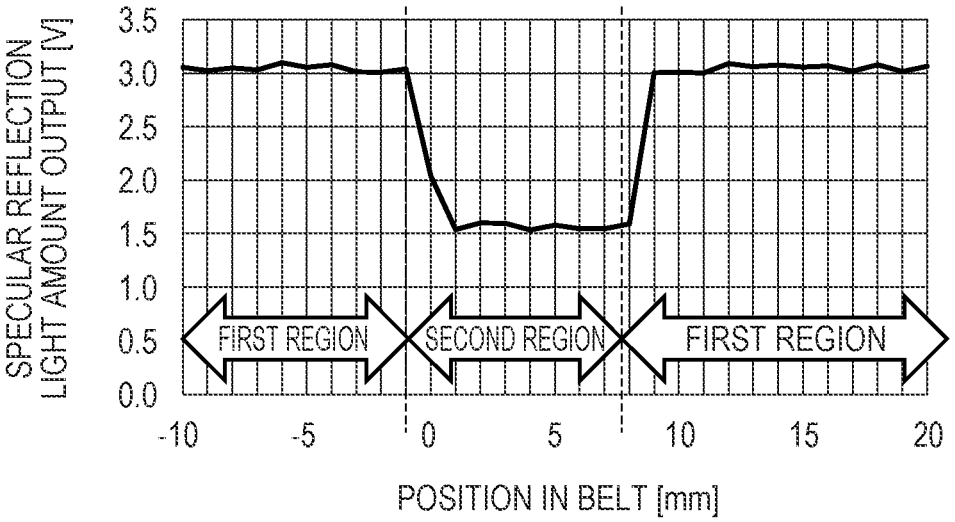

The manufactured electrophotographic belt was mounted on the electrophotographic image forming apparatus illustrated in FIG. 6, and the specular reflection output in the circumferential direction was observed. The results are illustrated in FIG. 14A. In addition, FIG. 14B is an enlarged chart obtained by extracting the vicinity of the second region from the chart illustrated in FIG. 14A. As illustrated in FIGS. 14A and 14B, the specular reflection output from the second region was greatly reduced with respect to the specular reflection output from the first region, and the deflection rate calculated using Equation (1) was 52%.

Note that the toner cleaning performance was evaluated in the same manner as that of Example 1. It was determined that the electrophotographic belt was ranked as A when the toner cleaning defect did not occur in the process of passing 200,000 sheets. In addition, the halftone image performance was evaluated in the same manner as that of Example 1. It was determined that the electrophotographic belt was ranked as A when no streaky density unevenness due to the groove pattern formed in the surface of the electrophotographic belt was observed.

Examples 2 and 3

An electrophotographic belt was manufactured and evaluated in the same manner as that of Example 1, except that the intervals (P) between the convex patterns of the cylindrical mold 905 for providing grooves were 100 μm and 3.0 μm, respectively.

Examples 4 to 6

An electrophotographic belt was manufactured in the same manner as that of Example 1, except that in the process of continuously forming the convex patterns of the cylindrical mold 905 for providing grooves in a spiral shape, the angles formed in the circumferential direction of the convex pattern of the cylindrical mold for providing grooves were 0.01°, 0.9°, and 3.0°, respectively. The electrophotographic belt thus manufactured was subjected to evaluation.

Example 7

After the cylindrical mold 905 for providing grooves was half-circumferentially pressed against the cylindrical belt holding mold 900, the cylindrical mold 905 for providing grooves was released and then slid by 10 μm in the vertical direction, and the cylindrical belt holding mold 900 was further reversely rotated by a circumferential length of 8 mm in the reverse direction. In this state, when the cylindrical mold 905 for providing grooves was half-circumferentially pressed against the cylindrical belt holding mold 900 again, the cylindrical mold 905 for providing grooves was released. An electrophotographic belt was manufactured in the same manner as that of Example 1 except for the above operation. Therefore, two second regions were provided in the circumferential direction of the electrophotographic belt. The electrophotographic belt thus manufactured was subjected to evaluation.

Example 8

Two regions having different patterns were provided on the surface of the cylindrical mold 905 having a diameter of 232.4 mm (circumferential length of 730 mm) and a length of 250 mm.

In the first region occupying the range of 704 mm in the circumferential direction of the cylindrical mold 905, a convex shape is formed at an angle in the circumferential direction of 0.1° so that H=3.5 μm, Wb=2.0 μm, Wt=0.2 μm, and P=20 μm.

In the second region other than the first region, the convex shape is formed at an angle in the circumferential direction of 0.1° so that H=3.5 μm, Wb=2.0 μm, Wt=0.3 μm, and P=15 μm.

In the present example, an electrophotographic belt was processed using the cylindrical mold 905.

In the present example, the second region of the cylindrical mold 905 is brought into contact with the cylindrical belt holding mold 900 and is pressurized to 8.0 kN at a rate of 1.0 kN/s, and at the same time as reaching 8.0 kN, the phase of the cylindrical mold 905 is adjusted so that the first region of the cylindrical mold 905 is in contact with the cylindrical belt holding mold 900. Thereafter, the cylindrical belt holding mold 900 and the cylindrical mold 905 for providing grooves are rotated while maintaining the pressurizing force at 8.0 kN, and the second region of the cylindrical mold 905 is in contact with the cylindrical belt holding mold 900 at the timing when the portion where the cylindrical belt holding mold 900 is started to be in contact with the cylindrical mold 905 for providing grooves is rotated more than one round of the cylindrical belt holding mold 900.

Thereafter, a load of the cylindrical mold 905 was reduced at a rate of 1.0 kN/s to release the cylindrical mold 905 for providing grooves.

The electrophotographic belt thus manufactured was subjected to evaluation.

Comparative Examples 2 to 8

An electrophotographic belt was manufactured in the same manner as that of Examples 2 to 8, except that the cylindrical mold 905 was pressurized and depressurized in a state where the cylindrical mold 905 and the cylindrical belt holding mold 900 were stopped in the same manner as that of Comparative Example 1 when grooves were formed using an imprint processing apparatus. Then, the electrophotographic belt thus manufactured was subjected to evaluation.

The evaluation results of the electrophotographic belts of Examples 1 to 8 are shown in Table 2. In addition, the evaluation results of the electrophotographic belts of Comparative Examples 1 to 8 are shown in Table 3.

TABLE 2

| | | | Example | | | | | | | |
|---|---|---|---|---|---|---|---|---|---|---|
| | | | 1 | 2 | 3 | 4 | 5 | 6 | 7 | 8 |
| | Cylindrical mold diameter (mm) | | 50 | 50 | 50 | 50 | 50 | 50 | 50 | 232 |
| | P (μ) | | 20.0 | 100.0 | 3.0 | 20.0 | 20.0 | 20.0 | 20.0 | 20.0<br>15.0 |
| | H (μm) | | 3.0 | 3.0 | 3.0 | 3.0 | 3.0 | 3.0 | 3.0 | 3.0 |
| | Wt (μm) | | 0.2 | 0.2 | 0.2 | 0.2 | 0.2 | 0.2 | 0.2 | 0.2<br>0.3 |
| | Wb (μm) | | 2.0 | 2.0 | 2.0 | 2.0 | 2.0 | 2.0 | 2.0 | 2.0 |
| Evaluation (1) | Angle q in circumferential direction of groove (°) | | 0.1 | 0.1 | 0.1 | 0.01 | 0.9 | 3.0 | 0.1 | 0.1 |
| | Number of grooves in first region (number) | | 12200 | 2440 | 81333 | 12200 | 12200 | 12200 | 12200 | 12200 |
| | Number of grooves in second region (number) | | 24401 | 4881 | 162666 | 24401 | 24401 | 24401 | 24401 | 18301 |
| | Number of second regions (number) | | 1 | 1 | 1 | 1 | 1 | 1 | 2 | 1 |
| | Length of second region (mm) | | 8 | 8 | 8 | 8 | 8 | 8 | 8<br>8 | 8 |
| Evaluation (2) | Presence or absence of changes in width and depth of groove in circumferential direction | First region | Absent | Absent | Absent | Absent | Absent | Absent | Absent | Absent |
| | | Second region | Present | Present | Present | Present | Present | Present | Present | Present |
| Evaluation (3) | Sensing deflection rate (%) | | 3 | 4 | 3 | 3 | 3 | 3 | 3 | 6 |
| Evaluation (4) | Toner cleaning performance evaluation rank | | A | A | A | A | A | A | A | A |
| Evaluation (5) | Halftone image performance evaluation rank | | A | A | A | A | A | A | A | A |

TABLE 3

| | | Comparative Example | | | | | | | |
|---|---|---|---|---|---|---|---|---|---|
| | | 1 | 2 | 3 | 4 | 5 | 6 | 7 | 8 |
| | Cylindrical mold diameter (mm) | 50 | 50 | 50 | 50 | 50 | 50 | 50 | 232 |
| | P (μm) | 20.0 | 100.0 | 3.0 | 20.0 | 20.0 | 20.0 | 20.0 | 20.0<br>15.0 |
| | H (μm) | 3.0 | 3.0 | 3.0 | 3.0 | 3.0 | 3.0 | 3.0 | 3.0 |
| | Wt (μm) | 0.2 | 0.2 | 0.2 | 0.2 | 0.2 | 0.2 | 0.2 | 0.3 |
| | Wb (μm) | 2.0 | 2.0 | 2.0 | 2.0 | 2.0 | 2.0 | 2.0 | 2.0 |
| Evaluation (1) | Angle q in circumferential direction of groove (°) | 0.1 | 0.1 | 0.1 | 0.01 | 0.9 | 3.0 | 0.1 | 0.1 |
| | Number of grooves in first region (number) | 12200 | 2440 | 81333 | 12200 | 12200 | 12200 | 12200 | 12200 |
| | Number of grooves in second region (number) | 24401 | 4881 | 162666 | 24401 | 24401 | 24401 | 24401 | 24401 |
| | Number of second regions (number) | 1 | 1 | 1 | 1 | 1 | 1 | 2 | 1 |

TABLE 3-continued

| | | | Comparative Example | | | | | | | |
|---|---|---|---|---|---|---|---|---|---|---|
| | | | 1 | 2 | 3 | 4 | 5 | 6 | 7 | 8 |
| | Length of second region (mm) | | 8 | 8 | 8 | 8 | 8 | 8 | 8<br>8 | 8 |
| Evaluation (2) | Presence or absence of changes in width and depth of groove in circumferential direction | First region | Absent | Absent | Absent | Absent | Absent | Absent | Absent | Absent |
| | | Second region | Absent | Absent | Absent | Absent | Absent | Absent | Absent | Absent |
| Evaluation (3) | Sensing deflection rate (%) | | 53 | 54 | 53 | 52 | 53 | 53 | 56 | 57 |
| Evaluation (4) | Toner cleaning performance evaluation rank | | A | A | A | A | A | A | A | A |
| Evaluation (5) | Halftone image performance evaluation rank | | A | A | A | A | A | A | A | A |

As shown in Table 2, in Examples 1 to 8, as illustrated in FIG. 1B, the groove 200 formed in the second region includes the groove 200-2 that has a width gradually decreasing in the first circumferential direction A1 and the groove 200-3 that has a width gradually decreasing in the second circumferential direction A2. Therefore, the change in the specular reflection output was small in the first region and the second region. Thus, the deflection rate calculated using Equation (1) was small, and the sensing characteristics were excellent.

On the other hand, as shown in Table 3, in Comparative Examples 1 to 8, since the widths of the grooves included the second region were constant, the specular reflection output was greatly changed in the first region and the second region, and the deflection rate calculated using Equation (1) was increased. Therefore, the sensing characteristics were poor.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No.2021-026026, filed Feb. 22, 2021, and Japanese Patent Application No.2022-003534, filed Jan. 13, 2022, which are hereby incorporated by reference herein in their entirety.

What is claimed is:

1. An electrophotographic belt having an endless shape, having grooves in an outer surface of the electrophotographic belt, the grooves each extending in a circumferential direction of the electrophotographic belt, wherein the outer surface has at least:

a first region in which the number of the grooves in a direction orthogonal to the circumferential direction of the electrophotographic belt is n, where n represents an integer of 1 or more; and a second region in which the number of the grooves in the direction orthogonal to the circumferential direction of the electrophotographic belt is more than n, and the grooves in the second region include:

a first groove that has a width gradually decreasing in a first circumferential direction of the electrophotographic belt; and a second groove that is adjacent to the first groove and has a width gradually decreasing in a second circumferential direction opposite to the first circumferential direction.

2. The electrophotographic belt according to claim 1, wherein in the first region, the number of the grooves per width of 1 mm in the direction orthogonal to the circumferential direction of the electrophotographic belt is 8 to 500.

3. The electrophotographic belt according to claim 1, wherein the number of the grooves formed in the second region is 2n−10 or more and 2n+10 or less.

4. The electrophotographic belt according to claim 1, wherein a depth of the first groove gradually decreases as the width of the first groove gradually decreases, and a depth of the second groove gradually decreases as the width of the second groove gradually decreases.

5. The electrophotographic belt according to claim 1, wherein $\theta \neq 0°$, in which θ is a narrow angle formed by the groove formed in the first region and a straight line parallel to the circumferential direction.

6. The electrophotographic belt according to claim 5, wherein θ is greater than −3° and less than 3°.

7. The electrophotographic belt according to claim 1, wherein a width of the grooves in each of the first region and the second region is in a range of 0.10 μm to 3.00 μm.

8. The electrophotographic belt according to claim 1, wherein widths of the grooves in the first region are constant.

9. The electrophotographic belt according to claim 1, further comprising:

a base layer having an endless shape; and a surface layer formed on an outer circumferential surface of the base layer, wherein the grooves are provided in an outer circumference of the surface layer.

10. An electrophotographic image forming apparatus comprising:

an intermediate transfer belt having an endless shape; and a cleaning member in contact with an outer circumferential surface of the intermediate transfer belt, wherein the intermediate transfer belt is an electrophotographic belt having an endless shape, wherein the electrophotographic belt has grooves in an outer surface of the electrophotographic belt and the grooves are extending in a circumferential direction of the electrophotographic belt, the outer surface has at least:

a first region in which the number of the grooves in a direction orthogonal to the circumferential direction of the electrophotographic belt is n, where n represents an integer of 1 or more; and a second region in which the number of the grooves in the direction orthogonal to the circumferential direction of the electrophotographic belt is more than n, and the grooves present in the second region include:

a first groove that has a width gradually decreasing in a first circumferential direction of the electrophotographic belt; and a second groove that is adjacent to the first groove and has a width gradually decreasing in a second circumferential direction opposite to the first circumferential direction.

* * * * *